United States Patent [19]

Maguire

[11] 4,159,099

[45] Jun. 26, 1979

[54] SLEEVE ASSEMBLY FOR FORMING OPENINGS IN MOLDED STRUCTURES

[76] Inventor: James V. Maguire, 2145 Santa Clara Ave., Apt. K, Alameda, Calif. 94501

[21] Appl. No.: 795,064

[22] Filed: May 9, 1977

[51] Int. Cl.[2] ..... E04G 17/08

[52] U.S. Cl. ..... 249/93; 249/43; 249/177; 249/217

[58] Field of Search ..... 249/40–43, 249/177, 213–214, 216–217, 93

[56] References Cited

U.S. PATENT DOCUMENTS

| | | | |
|---|---|---|---|
| 395,061 | 12/1888 | Kellogg | 249/177 |
| 1,767,834 | 6/1930 | Carlson | 249/43 |
| 2,314,866 | 3/1943 | Bosco | 249/43 |
| 2,968,855 | 1/1961 | Stolz | 249/177 |

FOREIGN PATENT DOCUMENTS

| | | | |
|---|---|---|---|
| 1074965 | 7/1967 | United Kingdom | 249/43 |

*Primary Examiner*—Francis S. Husar
*Assistant Examiner*—John McQuade
*Attorney, Agent, or Firm*—Fitch, Even & Tabin

[57] ABSTRACT

A sleeve assembly for forming a lined opening in molded structures made from concrete or the like, the sleeve providing the lining and being held in place during formation of the structure by a pair of conical sleeve lock elements having extended tapering surfaces for supporting sleeves of a variety of sizes, the sleeve lock elements preferably being held in place upon forming panels for the structure by means of a central stabilizing rod penetrating through the sleeve lock elements and the panels. An additional embodiment of the sleeve assembly is adapted to be secured to a generally horizontal panel upon which a molded structure such as a floor is formed.

8 Claims, 3 Drawing Figures

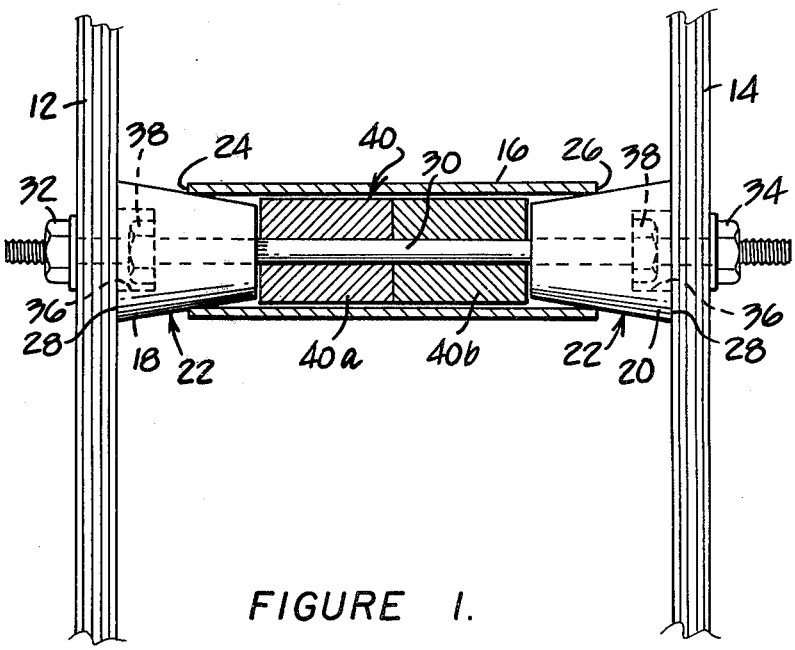
FIGURE 1.
FIGURE 3.
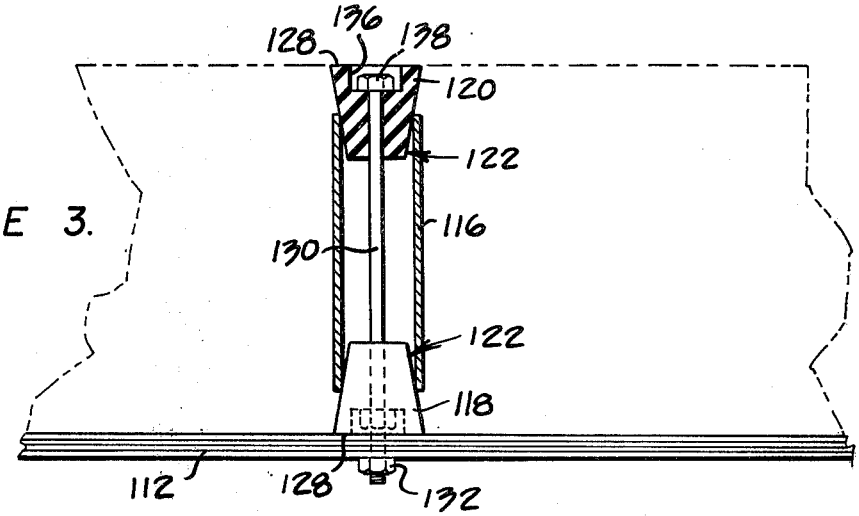
FIGURE 2.
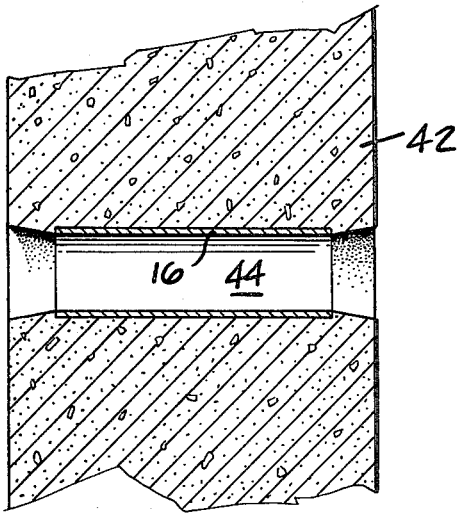

SLEEVE ASSEMBLY FOR FORMING OPENINGS IN MOLDED STRUCTURES

BACKGROUND OF THE INVENTION

The present invention relates generally to a sleeve assembly for forming a lined opening in molded structures made for example from concrete and more particularly to such a sleeve assembly which may be arranged either between generally vertical, spaced-apart panels defining surfaces of a molded structure formed therebetween or may extend upwardly from a generally horizontal panel upon which the molded structure is formed.

In the formation of molded structures, particularly in concrete walls or the like, it is commonly necessary to provide a relatively large number of accurately located and shaped openings to permit the passage of conduits of various types through the finished structure. Normally, such structures are formed with one or more panels defining various surfaces of the structure. For example, a vertical concrete wall is generally poured between two spaced apart, vertically arranged panels while a floor may be similarly poured upon one horizontally arranged panel. The upper surface of the floor is normally finished manually.

In any event, it is desirable to be able to form and maintain openings through the structure in a relatively simple manner which does not interfere with formation of the structure. Some of the problems encountered in this regard include specific arrangement and shape of the openings to be formed in the structure. When the structure is formed from relatively heavy material such as concrete, the weight of the concrete being poured between the forms often tends to dislocate or deform elements intended to define an opening through the finished structure. In addition, when the opening is being formed through a horizontal structure such as the floor, it is desirable to provide means which may be readily installed upon a panel forming the bottom surface of the floor and remain in accurate alignment and extension thereabove during pouring or formation of the floor. Similarly, when the structure is being poured between two vertical forming panels, it is desirable that an element defining an opening through the structure be capable of simple and rapid installation between the panels while resisting the effect of forces developed during formation of the structure.

SUMMARY OF THE INVENTION

Accordingly, it is an object of the invention to provide a sleeve assembly capable of providing an accurate opening in a molded structure of the type referred to above.

It is particularly contemplated that the sleeve assembly include a tubular sleeve designed to remain in place within the molded structure in order to provide a lining for the opening. The tubular sleeve is positioned relative to at least one forming panel by means of a sleeve lock element having a tapered conical surface which bears against one end of the tubular sleeve.

In one embodiment of the sleeve assembly adapted for installation between a pair of spaced apart panels, two such conical sleeve lock elements are employed at opposited ends of the tubular sleeve while being accurately positioned upon the respective panels. In another embodiment adapted for arrangement upon a single generally horizontal panel above which a molded structure is to be formed, one sleeve lock element is secured to the panel and similarly bears against a tubular sleeve while a means at the opposite end of the sleeve serves to maintain the sleeve in engagement with the sleeve lock element.

In all such embodiments such as those described above, the tapered conical surface of each sleeve lock element is sufficiently long to permit its bearing engagement against the ends of tubular sleeves of different sizes. Preferably, the means for securing the sleeve lock elements upon the panels comprises a central stabilizing rod which penetrates the sleeve lock element and the panel. The central stabilizing rod may be secured in place relative to the panel for example by means of a threaded nut which may be readily removed when the panels are withdrawn from the completed structure.

Additional objects and advantages of the invention are made apparent in the following description having reference to the accompanying drawings.

BRIEF DESCRIPTION OF THE DRAWINGS

FIG. 1 is a partially sectioned view of a sleeve assembly according to the present invention arranged in place between a pair of spaced apart panels for forming a molded structure.

FIG. 2 is a view of the molded structure of FIG. 1 with the forming panels and sleeve assembly removed except for a tubular sleeve forming a lining for an opening through the structure.

FIG. 3 is a view of another emboidment of the sleeve assembly secured to a generally horizontal panel for forming a molded structure such as a concrete floor.

DESCRIPTION OF THE PREFERRED EMBODIMENTS

Referring now to the drawings, the present invention is particularly directed toward a sleeve assembly contemplated for forming a lined opening in molded structures of concrete for example. Such structures may include a vertical wall for example of a type formed between two spaced apart panels as illustrated in FIG. 1. A wall structure is also illustrated in FIG. 2. The molded structure may also take the configuration of a horizontal floor formed upon a single panel of the type illustrated in FIG. 3.

Referring particularly to FIG. 1, a sleeve assembly according to the present invention is arranged between a pair of spaced apart vertical forming panels 12 and 14. The panels 12 and 14 may be sheets of plywood or other material selected to define opposite surfaces of a structure molded therebetween. Usually, when a wall of concrete or the like is formed between two such spaced apart panels, the panels are erected and the concrete is then poured between them. The heavy wet concrete being poured between the panels contacts the sleeve assembly and tends to result in dislocation or deformation of the sleeve assembly.

It is particularly important that the sleeve assembly be relatively simple and inexpensive while having a design facilitating its installation upon the panels and resisting both dislocation relative to the panels and deformation particularly of the tubular sleeve which forms a lining for an opening resulting in the molded structure.

To accomplish these purposes, the sleeve assembly includes a tubular sleeve 16 having a length substantially less than the distance between the spaced apart panels 12 and 14. Frustoconical sleeve lock elements 18 and 20 are arranged at opposite ends of the sleeve 16 for engagement with the respective panels 12 and 14. Each of the sleeve lock elements 18 and 20 has a conically tapered surface 22 adapted to bear against the respective ends 24 and 26 of the tubular sleeve 16. An opposing end surface 28 of each sleeve lock element is arranged to bear against the respective panels 12 and 14.

Thus, with the sleeve lock elements 18 and 20 being accurately located relative to the panels 12 and 14, the tubular sleeve 16 also tends to remain accurately positioned during formation of the molded structure. The tapered surfaces 22 of the respective sleeve lock elements are suffciently long in order to receive and bear against tubular sleeves of different sizes. For example, the tubular sleeve 16 may be formed from thin-walled material, such as galvanized metal having a relatively large inside diameter. On the other hand, the tubular sleeve 16 may also be formed from a rigid material such as cast iron pipe providing substantially increased strength while having a relatively reduced inside diameter.

It will thus be immediately apparent that different types of sleeves and even different overall sizes of sleeves may be accurately positioned and maintained by the same sleeve lock elements. Still further, the tapered sleeve lock elements tend to form a tapered opening in the molded concrete structure following removal of the panels 12 and 14 and all components of the sleeve assembly except for the sleeve 16. Thus, after a conduit or the like is arranged within the opening formed in the molded structure (see FIG. 2), the ends of the opening may be grouted in order to seal the opening through the structure.

In order to facilitate removal of the sleeve lock elements 18 and 20, their tapered surfaces 22 are preferably smooth. The sleeve lock elements 18 and 20 may also be formed from a plastic material or the like having a generally waxy surface in order to further facilitate their release from the molded structure. The tapered surfaces 22 form an angle within the approximate range of five to thirty degrees while preferably being within the range of five to ten degrees in order to accurately maintain the position of the tubular space 16.

As noted above, the tubular sleeve 16 remains accurately located between the panels 12 and 14 when the location of the sleeve lock elements 18 and 20 is fixed relative to the respective panels. The sleeve lock elements are preferably located upon the panels by means of a central stabilizing rod 30 which extends through the tubular sleeve 16 and penetrates the sleeve lock elements 18 and 20 as well as the forming panels 12 and 14 to be secured in place by means of nuts 32 and 34 which are threaded onto opposite ends of the rod. Preferably, axial openings formed in the sleeve lock elements 18 and 20 to receive the rod 30 are approximately the same size as the rod to assure proper positioning of the sleeve lock elements relative to the panels. However, it will be apparent that other means might be employed to secure the sleeve lock elements in place upon the panels.

During the arrangement of forming panels for vertical concrete walls or the like, one panel such as that indicated at 12 in FIG. 1 may be mounted in place with all hardware being arranged adjacent that panel prior to erection of the spaced apart panel 14. The construction of the present sleeve assembly is also contemplated to facilitate its use in such a situation. In particular, the sleeve assembly may be preassembled with all of its components secured in place relative to one of the panels until the other panel is erected. For this reason, each of the sleeve lock elements 18 and 20 has a counter bore 36 so that the end portion 28 of each of the sleeve lock elements forms an annular surface. A nut 38 may be arranged within the counter bore 36 and secured to the central rod 30 in order to maintain the assembled relation of the sleeve lock elements 18 and 20 along with the tubular sleeve 16 while the entire assembly is mounted upon the forming panel 12 by means of the single nut 32. Thus, when the other panel 14 is erected, it need only be secured to the opposite end of the rod 30 by the nut 34.

As noted above, the tubular sleeve 16 may be selected from a variety of sizes or configurations. If the tubular sleeve is formed for example from a rigid cast iron pipe, it is sufficiently strong to resist deformation while being accurately positioned by the sleeve lock elements 18 and 20. However, if the tubular sleeve 16 is formed from a thin-walled material such as galvanized iron, it may tend to be deformed by the weight of wet concrete or the like being poured between the panels.

It is further contemplated that a variety of sleeve assemblies be provided particularly having tapered sleeve lock elements of different diameters to accommodate sleeves of widely varying diameters, for example, from 2½ to 8 inches. However, since the tapered surfaces of each sleeve assembly will engage and position sleeves of different sizes, only a limited number of different sleeve assemblies need be made available to accommodate such a wide variety of sleeve sizes.

The use of thin-walled material for the tubular sleeve may be particularly desirable since it can be cut to any length to fit between the panels 12 and 14. In order to accommodate the use of such a material, the present invention particularly contemplates the use of a mandrel 40 which extends between the sleeve lock elements 18 and 20 and has a diameter just smaller than the inside diameter of the tubular sleeve 16. Through such an arrangement, deformation of the tubular sleeve 16 may be prevented while the mandrel 40 is readily removable with the other components of the sleeve assembly once the molded structure is completed. Preferably, the mandrel is formed in sections such as those indicated at 40A and 40B in order to permit use of any number of the mandrels in order to accommodate different spacings between the panels 12 and 14.

It is believed that the manner of use for the sleeve assembly is clearly apparent from the preceding description. However, in summary, it is noted that the sleeve assembly 10 is installed between the panels 12 and 14 as shown in FIG. 1. Concrete or the like is then poured between the panels to form a molded structure. The panels 12 and 14 are then removed along with all components of the sleeve assembly except for the tubular sleeve 16. The sleeve 16 is left within the molded structure to form a lining along a substantial portion of the opening through the structure as illustrated in FIG. 2. Referring momentarily to FIG. 2, the molded structure is generally indicated at 42 and the opening formed through the structure by the sleeve assembly is generally indicated at 44.

Another embodiment of the sleeve assembly is illustrated in FIG. 3 and includes generally similar components as described above with reference to FIG. 1. The sleeve assembly in FIG. 3 is identified by similar numerical labels for the same components in the assembly of FIG. 1 while being preceded by the digit "1." In FIG. 3, the lower sleeve lock element 118 is secured to a generally horizontal forming panel 112 upon which a molded structure 142 is to be formed. The tubular sleeve 116 and other sleeve lock elements 120 are arranged thereabove and held in place by the central rod 130. The counter bore 136 within the upper sleeve lock element 120 permits the upper surface of the molded structure 142 to be finished flush with the end surface 128. After the molded structure 142 has been completely formed, the various components of the sleeve assembly except for its tubular sleeve 116 may be similarly removed in order to form a vertically extending opening through the structure.

Additional modifications and variations within the sleeve assembly of the present invention are believed readily apparent from the preceding description. Accordingly, the scope of the present invention is defined only by the following appended claims.

I claim:

1. A sleeve assembly for forming a lined opening in a molded structure formed from concrete or the like with at least one surface of the structure being defined by a forming panel, comprising a tubular sleeve selected from a plurality of sleeves of substantially different diameters and having a length substantially less than the thickness of the molded structure, a pair of cylindrically tapered sleeve positioning elements, each element having a cylindrically tapered surface bearing against a respective end of the tubular sleeve, at least one of said elements having an opposed bearing surface for engaging a forming panel, the cylindrically tapered surface of each sleeve positioning element being sufficiently long to assure bearing engagement along its tapered surface with the tubular sleeves of substantially different diameters, a central stabilizing rod extending axially through said sleeve positioning elements and extending outwardly from said bearing surface of said one element a distance exceeding the thickness of a forming panel, said one element having a counterbore therein extending from said bearing surface and forming an annular recess surrounding said rod, means attached to said rod for securing said elements against the ends of said sleeve, at least one of said securing means being in said annular recess formed by said counterbore, and means on said rod outwardly of said bearing surface of said one element for securing said sleeve assembly to a panel.

2. The sleeve assembly of claim 1 wherein the central rod, the sleeve positioning elements and the means securing said positioning elements are separable and retractable from the molded structure to form a passage therethrough which is lined by the sleeve.

3. The sleeve assembly of claim 1 wherein the cylindrically tapered surfaces of the two sleeve positioning elements define an angle in the approximate range of five to thirty degrees relative to the axes of the elements.

4. The sleeve assembly of claim 3 wherein each angle is approximately five to ten degrees.

5. The sleeve assembly of claim 1 wherein the tapered surfaces of the two sleeve positioning elements are formed from material which is readily releasable from the molded structure.

6. The sleeve assembly of claim 1 wherein the tubular sleeve is subject to deformation during formation of the molded structure and further comprising a mandrel having a diameter just less than the inside diameter of the sleeve, the mandrel being removably arranged inside the tubular sleeve and extending substantially between the sleeve positioning elements to resist deformation of the tubular sleeve during formation of the molded structure.

7. The sleeve assembly of claim 6 wherein the mandrel is formed in sections for adaptation to different thickness of the molded structure.

8. The sleeve assembly of claim 1 for use with a molded structure with opposite surfaces defined by spaced-apart forming panels wherein both of said sleeve positioning elements have an opposed bearing surface for engaging the respective forming panels, wherein said central stabilizing rod extends outwardly from each of said bearing surfaces a distance exceeding the thickness of the forming panels, wherein both of said elements have a counterbore therein extending from said bearing surface and forming an annular recess surrounding said rod, wherein said securing means are secured in both of said annular recesses, and wherein means are positioned on opposite ends of said rod outwardly of said bearing surfaces for securing said sleeve assembly to both of the panels.

* * * * *